US011542577B2

(12) United States Patent
Park et al.

(10) Patent No.: US 11,542,577 B2
(45) Date of Patent: Jan. 3, 2023

(54) MAGNESIUM ALLOY SHEET AND MANUFACTURING METHOD THEREOF

(71) Applicants: POSCO, Pohang-si (KR); RESEARCH INSTITUTE OF INDUSTRIAL SCIENCE & TECHNOLOGY, Pohang-si (KR)

(72) Inventors: Jae Sin Park, Pohang-si (KR); Taek Geun Lee, Pohang-si (KR); Dae Hwan Choi, Pohang-si (KR); Bae Mun Seo, Pohang-si (KR); Hye Ji Kim, Busan (KR); Jonggeol Kim, Busan (KR); Hye Jeong Kim, Pohang-si (KR); Yoonsuk Oh, Pohang-si (KR); Jae Eock Cho, Pohang-si (KR); Dong Kyun Choo, Pohang-si (KR)

(73) Assignee: POSCO HOLDINGS INC., Seoul (KR)

( * ) Notice: Subject to any disclaimer, the term of this patent is extended or adjusted under 35 U.S.C. 154(b) by 0 days.

(21) Appl. No.: 17/256,956

(22) PCT Filed: Dec. 3, 2018

(86) PCT No.: PCT/KR2018/015189
§ 371 (c)(1),
(2) Date: Dec. 29, 2020

(87) PCT Pub. No.: WO2020/022584
PCT Pub. Date: Jan. 30, 2020

(65) Prior Publication Data

US 2021/0140017 A1 May 13, 2021

(30) Foreign Application Priority Data

Jul. 18, 2018 (KR) ..... 10-2018-0083533

(51) Int. Cl.

| | |
|---|---|
| ***C22C 23/02*** | (2006.01) |
| ***C22F 1/06*** | (2006.01) |
| ***B21B 3/00*** | (2006.01) |
| ***B22D 7/00*** | (2006.01) |

(52) U.S. Cl.
CPC ..... *C22C 23/02* (2013.01); *B21B 3/00* (2013.01); *B22D 7/005* (2013.01); *C22F 1/06* (2013.01)

(58) Field of Classification Search
CPC ..... C22C 23/02; C22F 1/06
See application file for complete search history.

(56) References Cited

U.S. PATENT DOCUMENTS

| | | | |
|---|---|---|---|
| 2008/0138236 | A1 | 6/2008 | Bae et al. |
| 2013/0183193 | A1 | 7/2013 | Kim et al. |
| 2020/0087757 | A1 | 3/2020 | Park et al. |

FOREIGN PATENT DOCUMENTS

| | | | |
|---|---|---|---|
| CN | 102888546 | B | 3/2014 |
| CN | 104313427 | A | 1/2015 |
| EP | 3330393 | A1 | 6/2018 |
| JP | H04-157130 | A | 5/1992 |
| JP | H09-310131 | A | 12/1997 |
| JP | 2004-263280 | A | 9/2004 |
| KR | 10-2004-0042469 | A | 5/2004 |
| KR | 10-2010-0027152 | A | 3/2010 |
| KR | 10-2012-0026495 | A | 3/2012 |
| KR | 10-2012-0079638 | A | 7/2012 |
| KR | 10-2013-0075749 | A | 7/2013 |
| KR | 10-2016-0011136 | A | 1/2016 |
| KR | 10-1607258 | B1 | 3/2016 |
| KR | 10-1858856 | B1 | 5/2018 |
| KR | 10-2018-0068145 | A | 6/2018 |
| KR | 10-2018-0073532 | A | 7/2018 |
| KR | 10-2018-0074254 | A | 7/2018 |
| KR | 10-2018-0074357 | A | 7/2018 |
| KR | 10-2019-0078359 | A | 7/2019 |
| KR | 10-2019-0120227 | A | 10/2019 |
| KR | 10-2020-0009323 | A | 1/2020 |
| WO | 2009/001516 | A1 | 12/2008 |
| WO | 2018/117632 | A1 | 6/2018 |
| WO | 2018-117713 | A1 | 6/2018 |
| WO | 2018/117762 | A1 | 6/2018 |

OTHER PUBLICATIONS

English Machine Translation of Posco et al. (WO 2018/117632) (Jun. 28, 2018).*
Written Opinion and International Search Report dated Apr. 16, 2019 issued in International Patent Application No. PCT/KR2018/015189 (with English translation).
H. Choi, et al., "Development of the highly corrosion resistant AZ31 magnesium alloy by the addition of a trace amount of Ti," Journal of Alloys and Compounds, vol. 664 (2016), pp. 25-37.
Partial Supplementary European Search Report dated May 26, 2021, issued in corresponding European Patent Application No. 18927807.0.
Extended European Search Report dated Sep. 23, 2021 issued in European Patent Application No. 18927807.0.
Chinese Office Action dated Sep. 18, 2021 issued in Chinese Patent Application No. 201880095629.5.
Korean Notice of Allowance dated Apr. 19, 2021 issued in Korean Patent Application No. 10-2018-0083533.
Chinese Office Action dated Mar. 17, 2022 issued in Chinese Patent Application No. 201880095629.5.

* cited by examiner

*Primary Examiner* — Jessee R Roe
(74) *Attorney, Agent, or Firm* — Morgan, Lewis & Bockius LLP

(57) ABSTRACT

A magnesium alloy sheet according to an embodiment of the present invention includes greater than 3 wt % and less than or equal to 5 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, a balance amount of magnesium, and other inevitable impurities on the basis of a total of 100 wt %.

6 Claims, 6 Drawing Sheets

Comparative Example 6 Example 5

Comparative Example 6

Example 5

MAGNESIUM ALLOY SHEET AND MANUFACTURING METHOD THEREOF

CROSS-REFERENCE OF RELATED APPLICATIONS

This application is the U.S. National Phase under 35 U.S.C. § 371 of International Patent Application No. PCT/KR2018/0015189, filed on Dec. 3, 2018, which in turn claims the benefit of Korean Application No. 10-2018-0083533, filed on Jul. 18, 2018, the entire disclosures of which applications are incorporated by reference herein.

TECHNICAL FIELD

An embodiment of the present invention relates to a magnesium alloy sheet and a method of manufacturing the same.

BACKGROUND ART

A magnesium alloy is the lightest among structural metal materials and increasingly becomes important as a light weight material for transportation equipment as well as electronics and IT industries due to its excellent specific strength, specific rigidity, and vibration absorption capability. However, magnesium is an electrochemically active metal and has a disadvantage that corrosion rapidly proceeds when exposed to a corrosive environment, and thus is limitedly applied to materialization. Accordingly, in order to expand the application field of the magnesium alloy, it is necessary to develop a new highly corrosion-resistant magnesium material applicable to a harsh corrosive environment.

Pure magnesium is a very electrochemically active metal having a standard hydrogen electrode potential of −2.38 V or so, and when exposed to a corrosive environment, corrosion rapidly proceeds. Since a MgO film is formed on the surface in the atmosphere, the magnesium exhibits equivalent corrosion resistance to that of medium carbon steel or a general aluminum alloy, but since the surface film becomes unstable under the presence of moisture or in an acidic or neutral solution and thus forms no passivation, the corrosion rapidly proceeds. As a result of analyzing a Mg corrosion product, when exposed to an indoor and outdoor atmosphere, the Mg corrosion product is mainly composed of hydroxide, carbonate, moisture, and the like of magnesium. In general, corrosion of a metal material indicates a phenomenon that the metal material is destroyed through an electrochemical reaction with a surrounding environment and thus functionally declines or is structurally damaged or destroyed. Since the corrosion, which is an important phenomenon directly related to performance or life-span of metal products, causes damage to the products or structures, various methods for suppressing this corrosion are applied in most usage environments.

However, the corrosion phenomenon of a metal may be reversely used to differentiate functionality of products like biomaterials. A high corrosion-resistant magnesium material has various corrosion factors such as impurities, microstructures, surface states, corrosion environments, and the like and thus is designed and manufactured to have appropriate corrosion characteristics according to the usage environment by controlling types and contents of the impurities that are inevitably mixed during the alloy manufacture, types and contents of alloy elements that are artificially added to improve the characteristics, material-manufacturing methods and process conditions, and the like.

DISCLOSURE

B, Y, Ti, or a combination thereof is added to an AZ-based magnesium alloy to provide a magnesium alloy with simultaneously improved corrosion resistance and mechanical properties.

A magnesium alloy sheet according to an embodiment of the present invention may include greater than 3 wt % and less than or equal to 5 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, a balance amount of magnesium, and other inevitable impurities on the basis of a total of 100 wt %.

The magnesium alloy sheet may further include 0.001 wt % to 0.01 wt % of Ti.

A magnesium alloy sheet according to another embodiment of the present invention may include greater than 5 wt % and less than or equal to 9 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, 0.001 wt % to 0.01 wt % of Ti, a balance amount of magnesium, and inevitable impurities on the basis of a total of 100 wt %.

A MgO oxide layer may be disposed on the surface of the magnesium alloy sheet, and a Ti component may be included in the oxide layer.

The magnesium alloy sheet may include $Mg_{17}Al_{12}$ particles, and an average particle diameter of the particles may be less than or equal to 1 μm.

The magnesium alloy sheet may include $Mg_{17}Al_{12}$ particles, and a volume fraction of the particles may be less than or equal to 5% with respect to 100 volume % of the magnesium alloy sheet.

A method of manufacturing a magnesium alloy sheet according to another embodiment of the present invention includes preparing a molten alloy including greater than 3 wt % and less than or equal to 5 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, a balance amount of magnesium, and other inevitable impurities on the basis of a total of 100 wt %, casting the molten alloy to produce an ingot, homogenizing heat-treating the ingot, and rolling the homogenized heat-treated ingot.

In the preparing of the molten alloy, the molten alloy may further include 0.001 wt % to 0.01 wt % of Ti.

A method of manufacturing a magnesium alloy sheet according to another embodiment of the present invention includes preparing a molten alloy including greater than 5 wt % and less than or equal to 9 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, 0.001 wt % to 0.01 wt % of Ti, a balance amount of magnesium, and other inevitable impurities on the basis of a total of 100 wt %, casting the molten alloy to produce an ingot, homogenizing heat-treating the ingot, and rolling the homogenized heat-treated ingot.

The homogenizing heat-treating of the ingot may be performed in a temperature range of 380° C. to 420° C.

Specifically, it may be performed for 12 hours to 24 hours.

The rolling of the homogenized heat-treated ingot may be performed in a temperature range of 275° C. to 325° C.

The B, Y, Ti, or a combination thereof is added to the AZ-based magnesium alloy to provide a magnesium alloy with simultaneously improved corrosion resistance and mechanical properties.

Specifically, the B, Y, Ti, or a combination thereof may be controlled according to composition ranges of Al to provide a magnesium alloy with excellent corrosion resistance.

MODE FOR INVENTION

Figure 1:
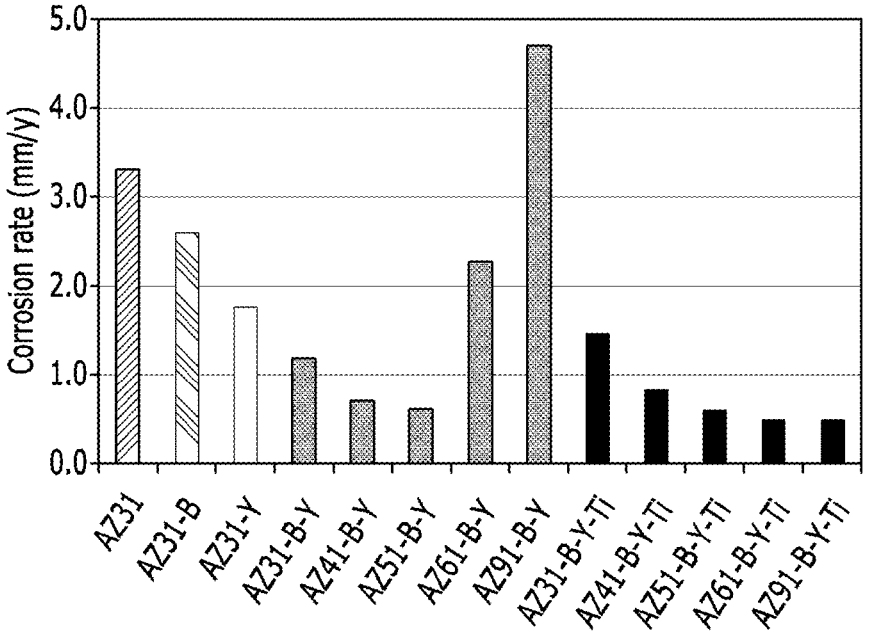
FIG. 1 is a graph showing the corrosion rates of examples and comparative examples.

Hereinafter, embodiments of the present invention are described in detail. However, these embodiments are exemplary, the present invention is not limited thereto, and the present invention is defined by the scope of claims.

A magnesium alloy sheet according to an embodiment of the present invention includes greater than 3 wt % and less than or equal to 5 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, a balance amount of magnesium, and other inevitable impurities on the basis of a total of 100 wt %.

Specifically, according to an embodiment of the present invention, the Al content may be in the range of greater than 3 wt % and less than or equal to 5 wt %. More specifically, the Al content may be in the range of greater than or equal to 3.2 wt % and less than or equal to 5.0 wt %. More specifically, the range may be greater than or equal to 3.5 wt % and less than or equal to 5.0 wt %.

As will be described later, according to another embodiment of the present invention, the Al content may be in the range of greater than 5 wt % and less than or equal to 9 wt %.

First, as for a magnesium alloy having the Al content of greater than 3 wt % and less than or equal to 5 wt % and including 0.5 wt % to 1.5 wt % of Zn, when boron (B) and yttrium (Y) are simultaneously added thereto, a corrosion rate may be effectively reduced.

Accordingly, B may be included in an amount of 0.001 wt % to 0.01 wt %. Specifically, when the boron is added in an amount of greater than 0.01 wt %, coarse Al—B secondary phases may be formed and deteriorate corrosion resistance. Accordingly, when the boron is added within the range, the corrosion rate may be the most effectively reduced.

Y may be included in the range of 0.1 wt % to 0.5 wt %.

Specifically, when Y is included in the range of less than 0.1 wt %, the corrosion rate-reducing effect may be insignificant. When Y is included in the range of greater than 0.5 wt %, coarse $Al_2Y$ and $Al_3Y$ secondary phases may be formed and deteriorate corrosion resistance.

The magnesium alloy sheet may further include Ti in the range of 0.001 wt % to 0.01 wt %.

Specifically, when Ti is added in the range of greater than 0.01 wt %, coarse Al—Ti secondary phases may be formed and deteriorate corrosion resistance.

Accordingly, a magnesium alloy having the Al content of greater than 3 wt % and less than or equal to 5 wt % and including 0.5 wt % to 1.5 wt % of Zn, when boron and yttrium are simultaneously added thereto within the above ranges, may exhibit excellent corrosion resistance.

Specifically, the magnesium alloy according to an embodiment of the present invention may be an AZ-based alloy, wherein aluminum and zinc may be used within the following composition ranges.

A magnesium alloy sheet according to another embodiment of the present invention includes greater than 5 wt % and less than or equal to 9 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, 0.001 wt % to 0.01 wt % of Ti, a balance amount of magnesium, and other inevitable impurities on the basis of a total of 100 wt %.

Specifically, an AZ-based magnesium alloy including greater than 5 wt % and less than or equal to 9 wt % of Al and 0.5 wt % to 1.5 wt % Zn, when boron (B), yttrium (Y), and titanium (Ti) are simultaneously added thereto, may effectively reduce a corrosion rate.

More specifically, as the composition range of the aluminum is increased, coarse secondary $Mg_{17}Al_{12}$ phases may be generated in a Mg matrix and deteriorate corrosion resistance.

Accordingly, Ti may be added thereto to increase Al solubility of the Mg matrix.

Specifically, when Ti is added thereto, a driving force for nucleation on $Mg_{17}Al_{12}$ phases, which are low-temperature stable phases, may be increased and thus promote formation of nano $Mg_{17}Al_{12}$ phases in the Mg matrix.

In other words, the $Mg_{17}Al_{12}$ phases have a smaller phase fraction and size, which may have an influence on decreasing micro-galvanic corrosion between the Mg matrix and the secondary phases.

Reasons for limiting the alloy components and their composition ranges are the same as described above.

Accordingly, a MgO oxide layer is disposed on the surface of the magnesium alloy, and the Ti component may be included in the oxide layer.

In this way, when titanium is included, corrosion resistance may be improved by inducing stability of the oxide layer.

Accordingly, as a result of measuring a corrosion rate in a salt immersion test method under a condition of using a 3.5 wt % NaCl solution at 25° C., the corrosion rate of the magnesium alloy sheet according to an embodiment or another embodiment of the present invention may be less than or equal to 1 mm/y. Accordingly, excellent corrosion resistance may be obtained.

The magnesium alloy sheet may include $Mg_{17}Al_{12}$ particle phases.

Herein, the particles may have an average particle diameter of less than or equal to 1 μm. Specifically, the average particle diameter may be to 100 nm to 1 μm.

Specifically, the component and composition of the magnesium alloy sheet may be controlled to make the average particle diameter of the $Mg_{17}Al_{12}$ particles small and thus minimize micro-galvanic corrosion of coarse $Mg_{17}Al_{12}$ secondary phases with the Mg matrix, and resultantly, improve corrosion resistance.

The magnesium alloy sheet includes $Mg_{17}Al_{12}$ particle phases, and the particles may be less than or equal to 5 volume % based on 100 volume % of the magnesium alloy sheet.

Specifically, as a result of controlling the Ti content within the range of 0.001 wt % to 0.01 wt %, a fraction of the $Mg_{17}Al_{12}$ particles may be controlled within the range.

Accordingly, the micro-galvanic corrosion of the coarse $Mg_{17}Al_{12}$ secondary phases with the Mg matrix may be minimized to improve corrosion resistance.

According to another embodiment of the present invention, a method of manufacturing the magnesium alloy sheet may include preparing a molten alloy including greater than 3 wt % and less than or equal to 5 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, a balance amount of magnesium, and other inevitable impurities on the basis of a total of 100 wt %, casting the molten alloy into an ingot, homogenizing/heat-treating the ingot, and rolling the homogenized/heat-treated ingot.

A method of manufacturing a magnesium alloy sheet according to yet another embodiment of the present invention includes preparing a molten alloy including greater than 5 wt % and less than or equal to 9 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, 0.001 wt % to 0.01 wt % of Ti, a balance amount of magnesium, and other inevitable impurities on the basis of a total of 100 wt %, casting the molten alloy to produce an ingot, homogenizing heat-treating the ingot, and rolling the homogenized heat-treated ingot.

Herein, the reason for limiting the component and composition of the molten alloy is the same as the aforementioned reason for limiting the component and composition of the magnesium alloy sheet, and thus will be omitted.

Specifically, the preparation step of the molten alloy is to charge pure magnesium (99.5% Mg) in a low carbon steel crucible and heat it up to 710° C. to 730° C. under a protective gas atmosphere to melt the pure magnesium.

Subsequently, when the pure magnesium is completely melted, a mother alloy having a high melting point may be added to the pure magnesium in a high melting point order. The high melting point order is Al—Ti, Al—B, Al—Mn, Al, Mg—Y, and Zn.

Then, the mother alloy and the pure magnesium are uniformly mixed by stirring for 10 minutes to 20 minutes.

Subsequently, the molten alloy is maintained without stirring for 5 minutes to 15 minutes, so that other unavoidable impurities or inclusions may sink down.

As a result, the molten alloy is prepared to have the components within the composition ranges.

Subsequently, the molten alloy is cast to produce an ingot. At this time, the molten alloy may be tapped into a preheated low-carbon steel mold to form an ingot. However, the present invention is not limited thereto.

Then, the ingot may be homogenized/heat-treated.

Herein, the homogenization/heat treatment may be performed at 380° C. to 420° C.

The homogenization/heat treatment may be performed for 12 hours to 24 hours.

The homogenization/heat treatment may be performed under the aforementioned condition to relieve stress generated during the molding.

Finally, the homogenized/heat-treated ingot may be rolled. The heat treated ingot may be rolled at 275° C. to 325° C.

Specifically, the ingot may be rolled at a reduction rate of 10% to 20% per roll. The rolling may be performed as aforementioned to obtain a magnesium alloy sheet with a desired thickness.

Hereinafter, in the present specification, the reduction rate is calculated by obtaining a thickness difference of a material between before the rolling and after the rolling, dividing the thickness difference by the thickness of the material before the rolling, and multiplying by 100.

The following examples illustrate the present invention in more detail. However, the following examples are only preferred examples of the present invention, and the present invention is not limited to the following examples.

EXAMPLES

Pure magnesium (99.5% Mg) was charged into a low carbon steel crucible and then heated up to 720° C. under a protective gas atmosphere to melt the pure magnesium. Thereafter, when the pure magnesium was completely melted, a mother alloy having the highest melting point was added thereto in a high melting point order. At this time, the molten alloy was stirred for about 10 minutes, so that the alloy elements were sufficiently mixed. Thereafter, a molten alloy was prepared by holding for about 10 minutes to settle inclusions in the molten alloy.

Thereafter, the molten alloy was tapped into a preheated low-carbon steel mold to cast an ingot.

The obtained ingot was homogenized/heat-treated at 400° C. for 10 hours.

The homogenized/heat-treated ingot was rolled at 300° C. Herein, the rolling was performed at a reduction rate of 15% per pass of rolling. As a result, a 1 mm-thick magnesium alloy sheet was obtained.

Comparative Examples

In Comparative Example 1, a commercially-available AZ31-based magnesium alloy was used.

The other comparative examples, compared with the examples, were adjusted to have different alloy compositions as shown in Tables 1 and 2.

Experimental Examples

Method of Evaluating Corrosion Rate

Corrosion rates of the examples and the comparative examples were measured to evaluate corrosion resistance.

Specifically, the corrosion rates were measured by using a 3.5 wt % NaCl solution at 25° C. in a salt immersion test method.

TABLE 1

| | | Alloy composition (wt %) | | | | | | Corrosion rate |
|---|---|---|---|---|---|---|---|---|
| | | Al | Zn | Mn | B | Y | Ti | (mm/y) |
| Comparative Example 1 | AZ31 | 3.04 | 0.74 | 0.30 | — | — | — | 3.32 |
| Comparative Example 2 | AZ31-B | 2.95 | 0.98 | 0.22 | 0.0076 | — | — | 2.60 |
| Comparative Example 3 | AZ31-Y | 2.26 | 0.78 | 0.20 | — | 0.22 | — | 1.77 |
| Comparative Example 4 | AZ31-B—Y | 2.91 | 0.90 | 0.18 | 0.0015 | 0.28 | — | 1.19 |
| Example 1 | AZ41-B—Y | 3.79 | 0.94 | 0.13 | 0.0015 | 0.30 | — | 0.71 |
| Example 2 | AZ51-B—Y | 4.87 | 0.96 | 0.18 | 0.0021 | 0.30 | — | 0.61 |
| Comparative Example 5 | AZ31-B—Y—Ti | 3.11 | 0.89 | 0.19 | 0.0015 | 0.27 | 0.0019 | 1.48 |
| Example 3 | AZ41-B—Y—Ti | 3.92 | 0.92 | 0.20 | 0.0020 | 0.40 | 0.0017 | 0.84 |
| Example 4 | AZ51-B—Y—Ti | 4.85 | 0.92 | 0.20 | 0.0018 | 0.29 | 0.0016 | 0.60 |

As shown in Table 1, when B or Y alone was added to AZ31 (Comparative Examples 2 and 3), corrosion resistance was slightly improved, compared with Comparative Example 1.

However, when B and Y were simultaneously added to AZ31 (Comparative Example 4), more excellent corrosion resistance was obtained, compared with Comparative Examples 1 to 3.

However, the examples more clearly exhibited the B and Y-adding effect.

Specifically, when B and Y were simultaneously added to Examples 1 and 2 including aluminum in a larger amount than Comparative Examples 1 to 4, an excellent corrosion rate of less than or equal to 1 mm/y was obtained.

More specifically, when titanium was further added to the examples (Examples 3 and 4), the corrosion rate was slightly increased but was less than or equal to 1 mm/y, which is still excellent.

However, as for Comparative Example 4 compared with Comparative Example 5, when titanium was further added, the corrosion rate was deteriorated.

TABLE 2

| | | Alloy composition (wt %) | | | | | | Corrosion rate |
|---|---|---|---|---|---|---|---|---|
| | | Al | Zn | Mn | B | Y | Ti | (mm/y) |
| Comparative Example 6 | AZ61-B—Y | 5.83 | 0.92 | 0.14 | 0.0073 | 0.26 | — | 2.27 |
| Comparative Example 7 | AZ91-B—Y | 8.41 | 0.95 | 0.085 | 0.0084 | 0.23 | — | 4.71 |
| Example 5 | AZ61-B—Y—Ti | 5.58 | 0.92 | 0.18 | 0.0021 | 0.31 | 0.0016 | 0.49 |
| Example 6 | AZ91-B—Y—Ti | 8.59 | 0.96 | 0.17 | 0.0016 | 0.23 | 0.0010 | 0.50 |

On the other hand, when the aluminum content exceeded 5 wt %, even though B and Y were simultaneously added, insufficient corrosion resistance was obtained.

Specifically, Comparative Examples 6 and 7 exhibited each corrosion rate of 2.27 mm/y and 4.71 mm/y, which were very deteriorated results.

On the other hand, when B, Y, and Ti in combination were added, Examples 5 and 6 exhibited a very excellent corrosion rate of 1 mm/y.

Method of Evaluating Mechanical Properties

Mechanical properties were evaluated by using a sheet-shaped specimen having a gage length of 25 mm and conducting a room temperature tensile test under a strain rate condition of $10^{-3}$1 s according to ASTM E8 to measure yield strength, tensile strength, and elongation rate.

TABLE 3

| | | Yield strength (Y.S, MPa) | Maximum tensile strength (U.T.S, MPa) | Elongation rate (El., %) |
|---|---|---|---|---|
| Comparative Example 1 | AZ31 | 201 | 272 | 19 |
| Comparative Example 4 | AZ31-B—Y | 186 | 273 | 19 |
| Example 5 | AZ61-B—Y—Ti | 243 | 321 | 15 |

As disclosed in Table 3, Example 5 exhibited significantly high yield strength and tensile strength without significantly decreasing an elongation rate.

The results shown in Tables 1 and 2 are confirmed through the drawings of the present invention.

FIG. 1 is a graph showing the corrosion rates of the examples and the comparative examples.

Figure 2:
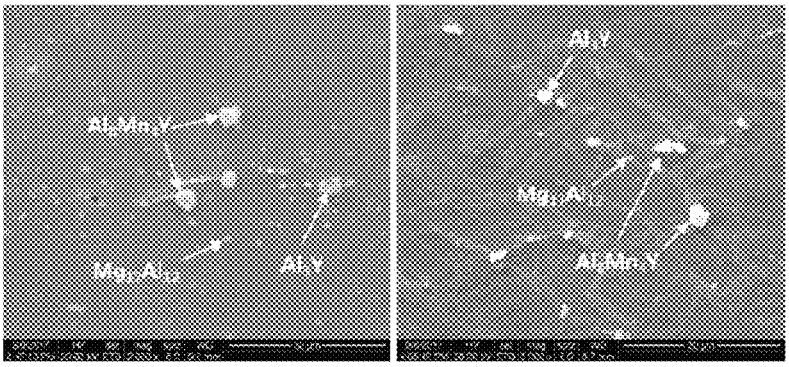
FIG. 2 is a photograph of microstructures of Comparative Example 6 and Example 5 observed by SEM.

FIG. 2 is a photograph of microstructures of Comparative Example 6 and Example 5 observed by SEM.

As shown in FIG. 2, Example 5 to which Ti was added exhibited relatively finer sized $Mg_{17}Al_{12}$ particles than Comparative Example 6. In addition, a phase fraction of the particles became lower.

Figure 3:
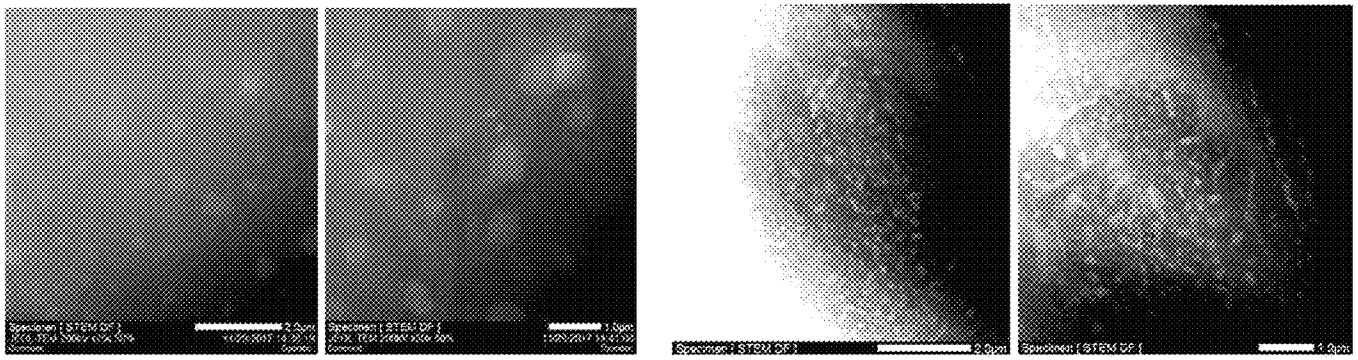
FIG. 3 is a photograph of microstructures of Comparative Example 6 and Example 5 observed by TEM.

The results were also confirmed through FIG. 3.

FIG. 3 is a photograph of microstructures of Comparative Example 6 and Example 5 observed by TEM.

As shown in FIG. 3, in Example 5 to which Ti was added, fine-sized $Mg_{17}Al_{12}$ particles were more produced than in Comparative Example 6 to which Ti was not added.

Figure 4:
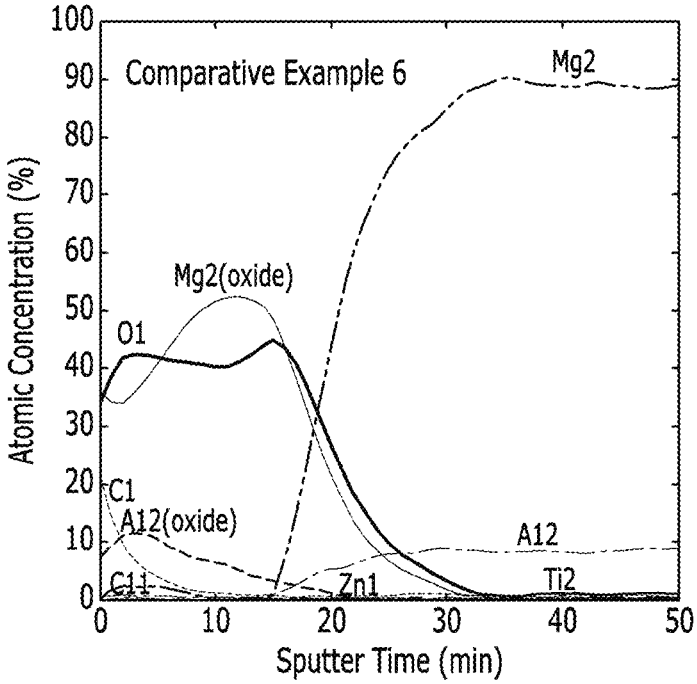
FIG. 4 shows the results of analyzing the surface oxide films of Comparative Example 6 and Example 5 using SAM.
Figure 4:
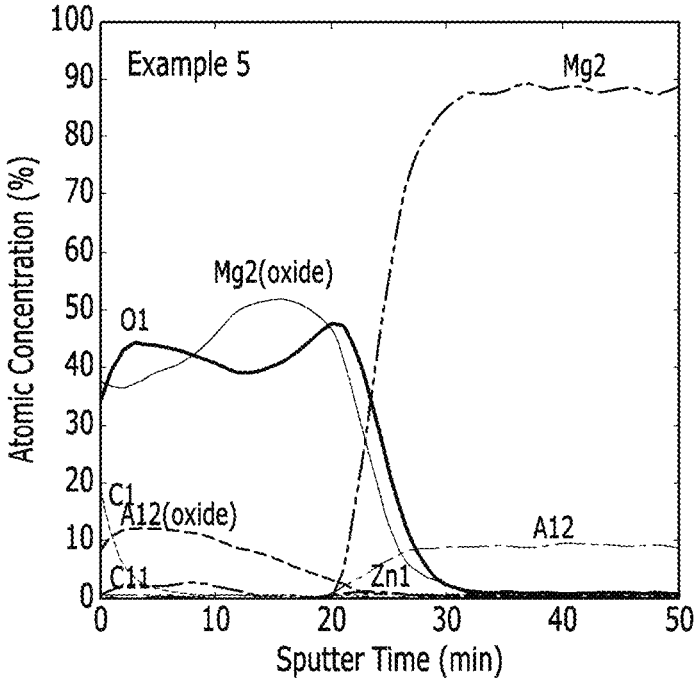

FIG. 4 shows the results of analyzing the surface oxide films of Comparative Example 6 and Example 5 using SAM.

Specifically, component depth profiles of the specimens in a depth direction were obtained by radiating an argon (Ar) ion beam on the surfaces with a SAM (Scanning Auger Microscopy) analysis device to analyze oxide film depth profiles of the alloy surfaces.

The depth profiles were measured at 2.5 nm/min within the sputtering time section of 0 to 10 minutes, at 6.4 nm/min within the sputtering time section of 10 to 30 minutes, and at 16.1 nm/min within the sputtering time section of 30 minutes or more.

As a result, on the surfaces of Example 5 and Comparative Example 6, an $Al_2O_3$ oxide film in addition to a MgO oxide film was formed in combination.

However, in Example 5, the $Al_2O_3$ oxide film was relatively thicker than in Comparative Example 6. The reason is that in Example 5, the added Ti slightly increased Al solubility in the Mg matrix and thus promoted formation of the $Al_2O_3$ oxide film.

The MgO oxide film had poor corrosion resistance due to the poorly dense structure, but when the $Al_2O_3$ oxide film having passivation properties was further formed, the $Al_2O_3$ oxide film suppressed growth of the MgO oxide film when exposed to a corrosion environment, and thus improved corrosion resistance compared with when the MgO oxide film alone was formed.

Figure 5:
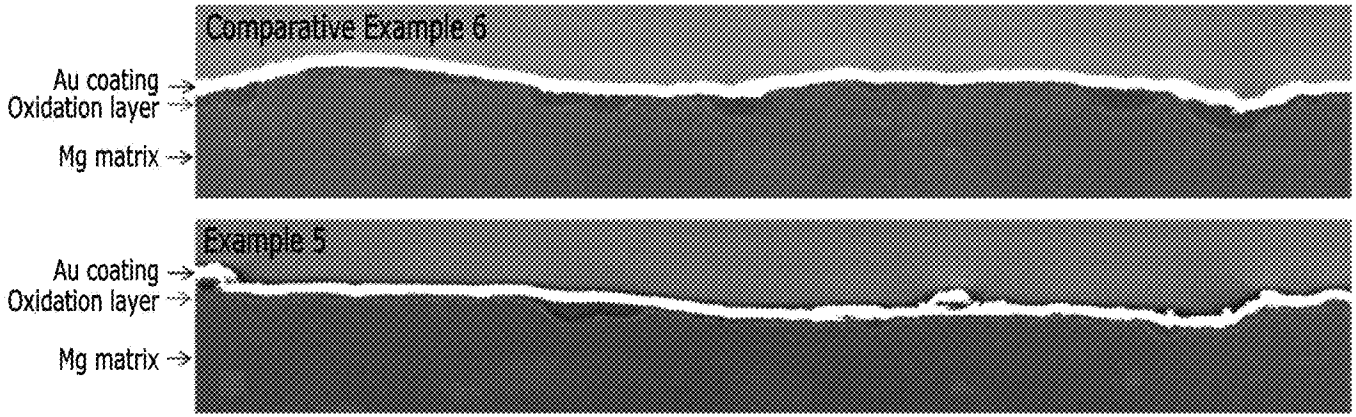
FIG. 5 shows the results of analyzing the surface oxide films of Comparative Example 6 and Example 5 using TEM.

This effect could be confirmed through FIG. 5.

FIG. 5 shows the results of analyzing the surface oxide films of Comparative Example 6 and Example 5 using TEM.

Specifically, oxide film stability on the surfaces after 1 hour of a salt immersion test is shown through the TEM results. A white layer on the surface of the specimens was formed by coating Au to perform the TEM analysis.

As a result, in Example 5 to which Ti was added, a nonuniform MgO oxide film was relatively less formed than in Comparative Example 6, and accordingly, the surface oxide film turned out to be more stable.

On the other hand, in Comparative Example 6, a region where the MgO surface oxide film locally grew was relatively more found after one hour of salt immersion.

In other words, since the region where the MgO surface oxide film locally grew was less found in Example 5, the oxide film turned out to be relatively more stable.

Figure 6:
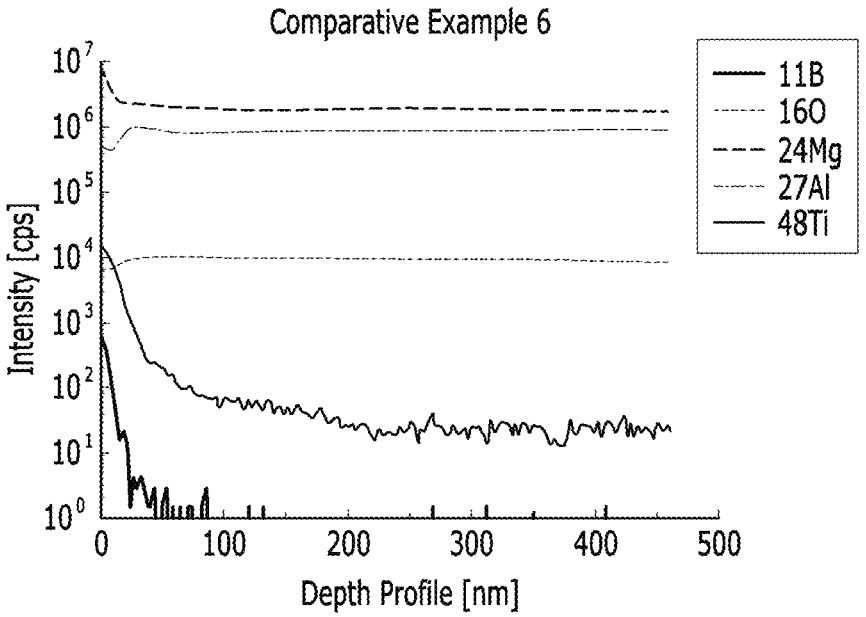
FIG. 6 shows the results of analyzing the alloy components of the surface oxide films of Comparative Example 6 and Example 5 using SIMS.
Figure 6:
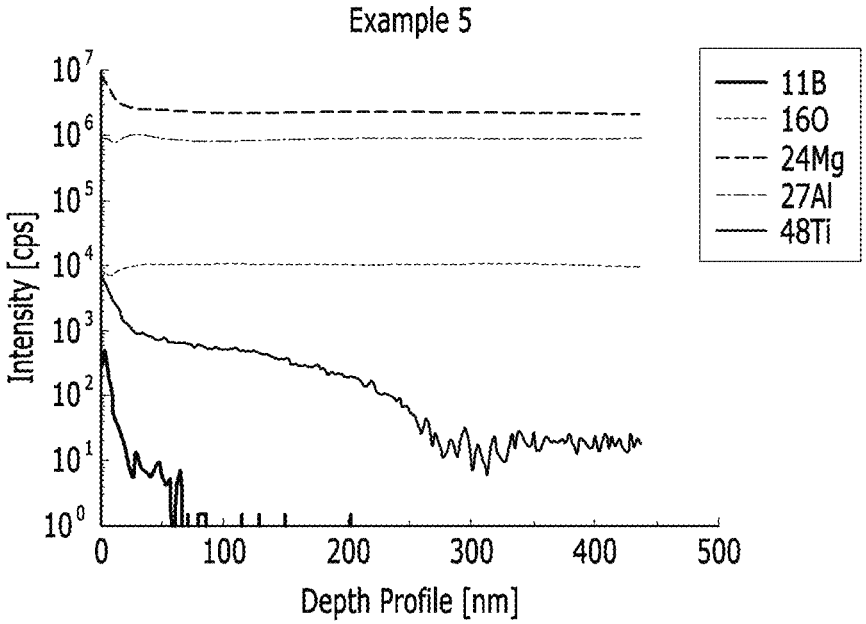

FIG. 6 shows the results of analyzing the alloy components of the surface oxide films of Comparative Example 6 and Example 5 using SIMS.

Specifically, a SIMS (Secondary Ion Mass Spectroscopy) analysis device was used to radiate $Cs^+$ ions on the surfaces of the specimens and analyze component profiles thereof in a depth direction. The analysis method can detect the components up to ppb units and thus is frequently used for semiconductor analysis and the like.

As a result, in Example 5, the Ti component was more detected in the surface oxide film (MgO), compared with in Comparative Example 6.

Specifically, the Ti component detected in the surface portion of Comparative Example 6 was identified by a background peak, and when compared with Example 5, the Ti component was more detected on the surface of Example 5.

Accordingly, the Ti component on the surface oxide film induced stability of the MgO oxide film and thus improved corrosion resistance.

The present invention is not limited to the above embodiments, but it will be appreciated that it may be manufactured in a variety of different forms, and those of ordinary skill in the art to which the present invention pertains can implement it with other specific forms without changing the technical spirit or essential features of the present invention. Therefore, the aforementioned embodiments should be understood to be exemplary but not limiting the present invention in any way.

The invention claimed is:

1. A magnesium alloy sheet, comprising greater than 3 wt % and less than or equal to 5 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, a balance amount of magnesium, and other inevitable impurities on the basis of a total of 100 wt %, wherein the magnesium alloy sheet further comprises 0.001 wt % to 0.01 wt % of Ti, wherein a MgO layer is disposed on the surface of the magnesium alloy sheet, and a Ti component is included in the oxide layer.

2. The magnesium alloy sheet of claim 1, wherein the magnesium alloy sheet comprises $Mg_{17}Al_{12}$ particles, and an average particle diameter of the particles is less than or equal to 1 μm.

3. The magnesium alloy sheet of claim 1, wherein the magnesium alloy sheet comprises $Mg_{17}Al_{12}$ particles, and a volume fraction of the particles is less than or equal to 5% with respect to 100 volume % of the magnesium alloy sheet.

4. A magnesium alloy sheet, which comprises greater than 5 wt % and less than or equal to 9 wt % of Al, 0.5 wt % to 1.5 wt % of Zn, 0.1 wt % to 0.5 wt % of Mn, 0.001 wt % to 0.01 wt % of B, 0.1 wt % to 0.5 wt % of Y, 0.001 wt % to 0.01 wt % of Ti, a balance amount of magnesium, and other inevitable impurities on the basis of a total of 100 wt %, wherein a MgO layer is disposed on the surface of the magnesium alloy sheet, and a Ti component is included in the oxide layer.

5. The magnesium alloy sheet of claim 4, wherein the magnesium alloy sheet comprises $Mg_{17}Al_{12}$ particles, and an average particle diameter of the particles is less than or equal to 1 μm.

6. The magnesium alloy sheet of claim 4, wherein the magnesium alloy sheet comprises $Mg_{17}Al_{12}$ particles, and a volume fraction of the particles is less than or equal to 5% with respect to 100 volume % of the magnesium alloy sheet.

* * * * *